US011486402B1

(12) United States Patent
Tzeng

(10) Patent No.: US 11,486,402 B1
(45) Date of Patent: Nov. 1, 2022

(54) COUNTER-ROTATING AXIAL AIR MOVING DEVICE STRUCTURE

(71) Applicant: Stokes Technology Development Ltd., Taoyuan (TW)

(72) Inventor: Yih-Wei Tzeng, Taoyuan (TW)

(73) Assignee: STOKES TECHNOLOGY DEVELOPMENT LTD., Taoyuan (TW)

( * ) Notice: Subject to any disclaimer, the term of this patent is extended or adjusted under 35 U.S.C. 154(b) by 96 days.

(21) Appl. No.: 17/233,425

(22) Filed: Apr. 16, 2021

(51) Int. Cl.
*F04D 19/02* (2006.01)
*F04D 19/00* (2006.01)
*F04D 29/54* (2006.01)

(52) U.S. Cl.
CPC ..... *F04D 19/007* (2013.01); *F04D 19/024* (2013.01); *F04D 29/544* (2013.01)

(58) Field of Classification Search
CPC .... F04D 19/007; F04D 19/024; F04D 29/544; B64C 11/48; B64C 11/306
See application file for complete search history.

(56) References Cited

U.S. PATENT DOCUMENTS 8,764,375 B2 * 7/2014 Kato ..... F04D 29/544 415/68
11,388,319 B2 * 7/2022 Hanjo ..... F04D 29/384
2021/0388839 A1 * 12/2021 Li ..... F04D 29/384

* cited by examiner

*Primary Examiner* — Sabbir Hasan
(74) *Attorney, Agent, or Firm* — Chun-Ming Shih; HDLS IPR Services

(57) ABSTRACT

A counter rotating axial air moving device structure is disclosed. The rear rotor includes a rear hub and rear blades, and a pitch angle of each of the rear blades increases gradually in a direction away from the rear hub. The front rotor, the rear rotor and the stator component are stacked with each other. The ratio of the thickness to the diameter is equal to or greater than about 0.25 and equal to or less than about 0.8. Therefore, a better performance curve is obtained, and the vibration and noise are avoided.

6 Claims, 9 Drawing Sheets

COUNTER-ROTATING AXIAL AIR MOVING DEVICE STRUCTURE

BACKGROUND

Technical Field

The technical field relates to an axial air moving device, and more particularly relates to a counter-rotating axial air moving device structure.

Description of Related Art

Please refer to FIG. 1A to FIG. 1D, which respectively depict a planar schematic view, two cross sectional views and a schematic view of the pitch angle of the blades of the axial air moving device in the related art. As shown in FIG. 1A, the counter-rotating axial air moving device la includes a hub 10*a* and a plurality of three-dimensional blades 20*a* connected to the periphery of the hub 10*a*. The three-dimensional blades 20*a* are configured by stacking multiple two-dimensional wing sections. Under the cylindrical coordinate, the wing sections are predetermined for each blade 20*a* on different radius positions and are lofted continuously to complete the configuration of the three-dimensional blade. As shown in FIG. 1B and FIG. 1C, which respectively depict schematic views of the pitch angle of the blade on the inner location of the blade (1B-1B section line) and on the outer location of the blade (1C-1C section line) in FIG. 1A. The blade structure of the counter-rotating axial air moving device of the related art is designed to have the pitch angle $\theta_B$ of the wing section in FIG. 1B (close to the hub 10*a*) greater than the pitch angle $\theta_C$ of the wing section in FIG. 1C (away from the hub 10*a*). As shown in FIG. 1D, the pitch angle of the blade in the related art decreases gradually on different radius positions (r/R). Specifically, the blade has larger pitch angle on the inner side and smaller pitch angle on the outer side.

In the design of the counter-rotating axial air moving device of the related art, the pitch angles of blades are varied as above description. The pitch angles of the front and rear blades both decrease gradually from the position near the hub in a direction away from the hub. However, the thin type counter-rotating axial air moving devices of the related art cannot withstand the high back pressure, and the performance may be significantly reduced. As a result, the rotation speed of the thin type counter-rotating axial air moving device of the related art must be increased to compensate for the performance, and the consequences of the deterioration of vibration and noise of the axial air moving device and the increasing of energy consumption arise.

SUMMARY OF THE DISCLOSURE

One object of this disclosure is to provide a thin type counter-rotating axial air moving device structure having a performance curve with the better characteristic of the static pressure versus air flowrate at the same rotation speed, so as to avoid the vibration and noise being deteriorated by keeping the rotation speed, and the energy consumption is also controlled.

In order to achieve the object mentioned above, this disclosure provides a counter-rotating axial air moving device structure that includes a front rotor and a rear rotor. The rear rotor is disposed on a downstream side of the front rotor and receives a forced air flow generated from the front rotor. The rear rotor includes a rear hub and a plurality of rear blades arranged on a periphery of the rear hub. A pitch angle of each of the rear blades increases gradually in a direction away from the rear hub. The front rotor and the rear rotor are stacked with each other to have a total thickness and a diameter, and a ratio of the total thickness to the diameter is equal to or greater than about 0.25 and equal to or less than about 0.8.

Comparing with the related art, the pitch angle of the rear rotor blades in this disclosure increases gradually from the inner side to the outer side. With such configuration, the counter-rotating axial air moving device structure of this disclosure has a performance curve with the better characteristic of the static pressure versus air flowrate at the same rotation speed. Therefore, the deterioration of vibration and noise may be avoided by keeping the rotation speed, and the energy consumption is also controlled.

BRIEF DESCRIPTION OF DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1A:
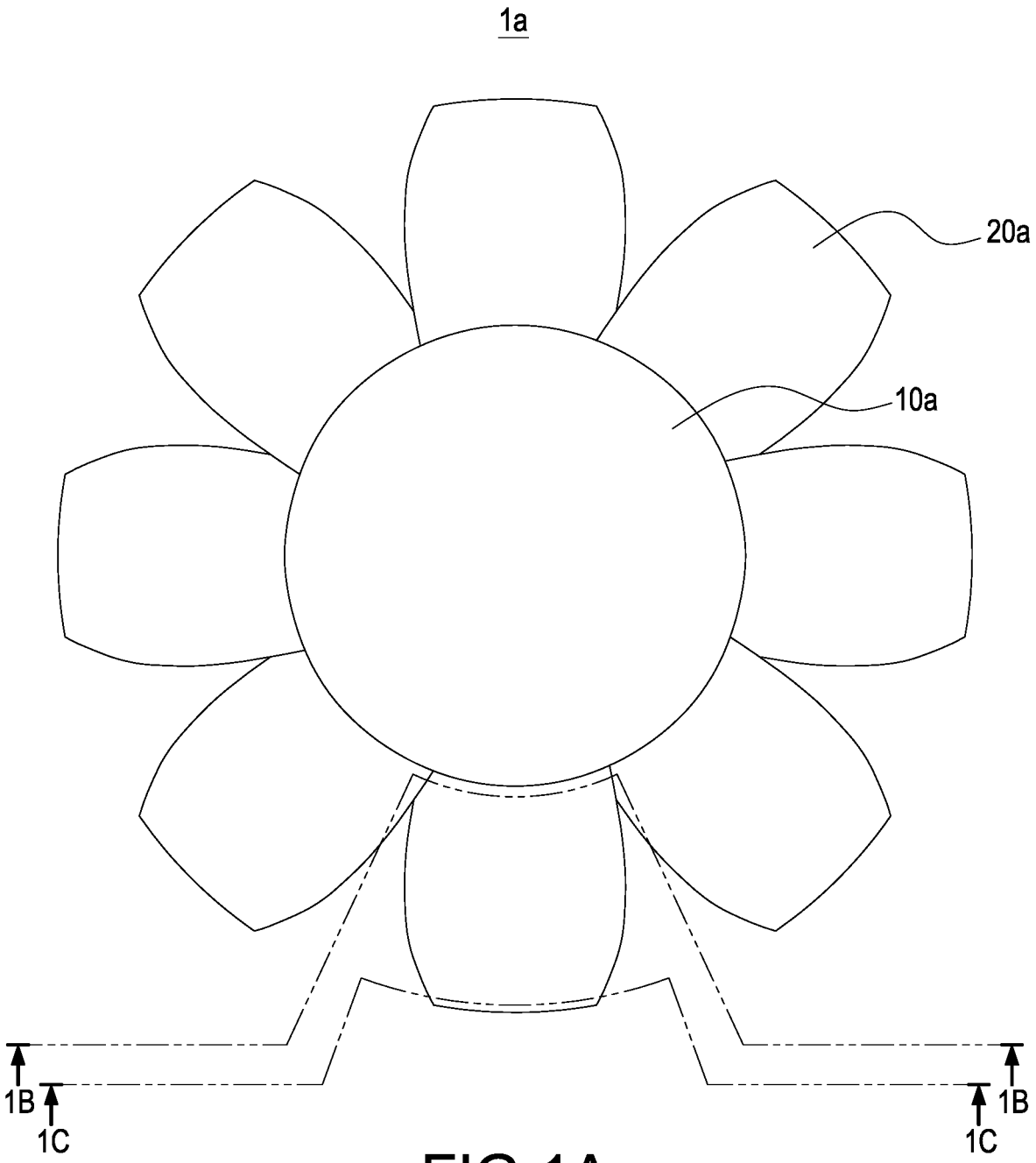
FIG.1A RELATED ART
FIG. 1A is a planar schematic view of the rear rotor of the counter-rotating axial air moving device in the related art.
Figure 1B:
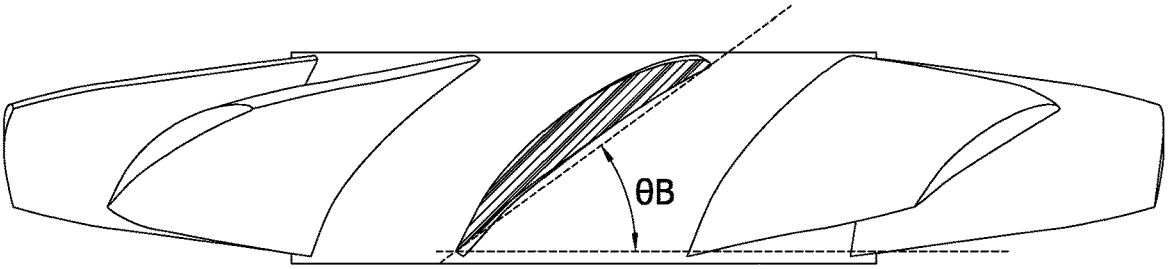
FIG.1B RELATED ART
FIG. 1B is a cross sectional view of line 1B-1B in FIG. 1A.
Figure 1C:
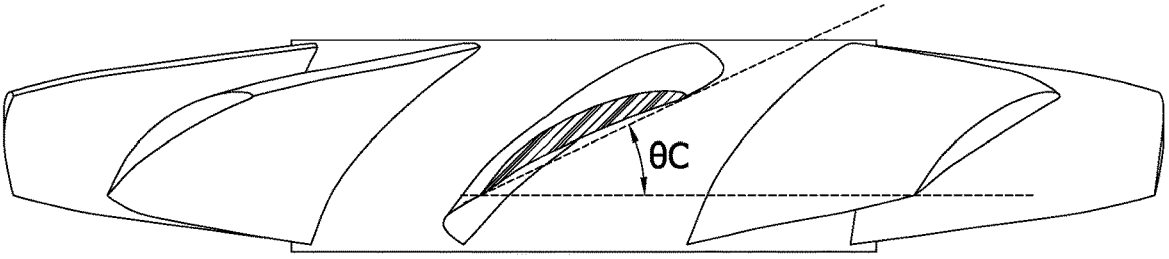
FIG.1C RELATED ART
FIG. 1C is a cross sectional view of line 1C-1C in FIG. 1A.
Figure 1D:
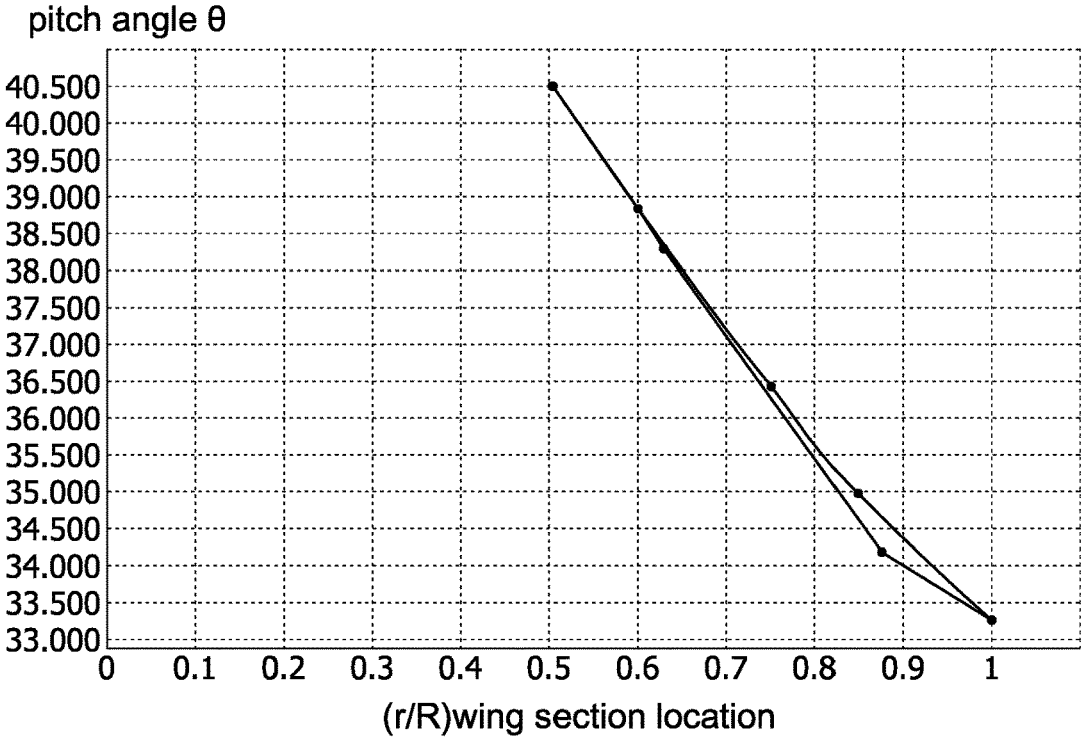
FIG.1D RELATED ART
FIG. 1D is a schematic diagram of the pitch angles of blades of the rear rotor of the axial air moving device in the related art.
Figure 2:
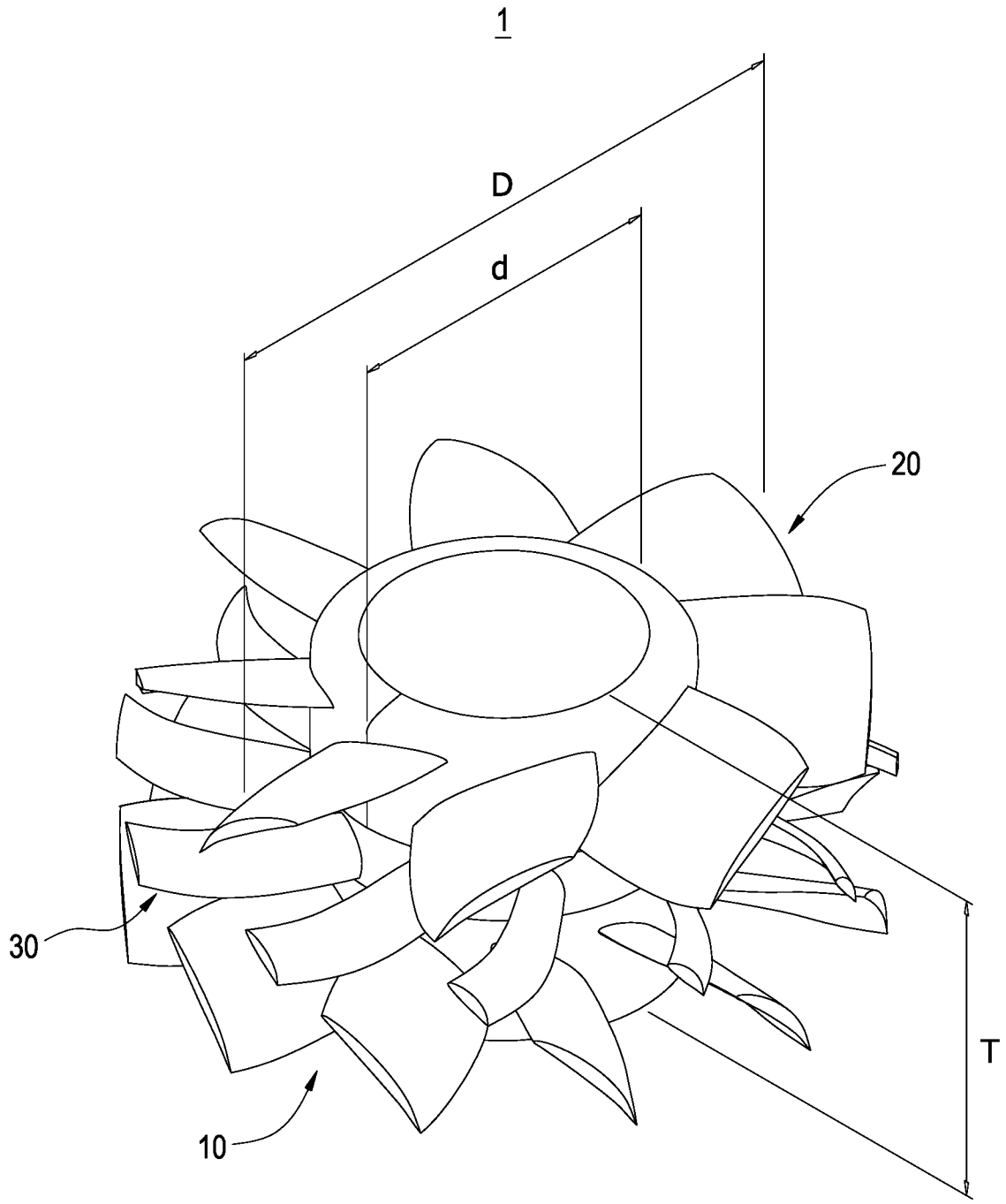
FIG. 2 is a perspective schematic view of the counter-rotating axial air moving device structure in this disclosure.
Figure 3:
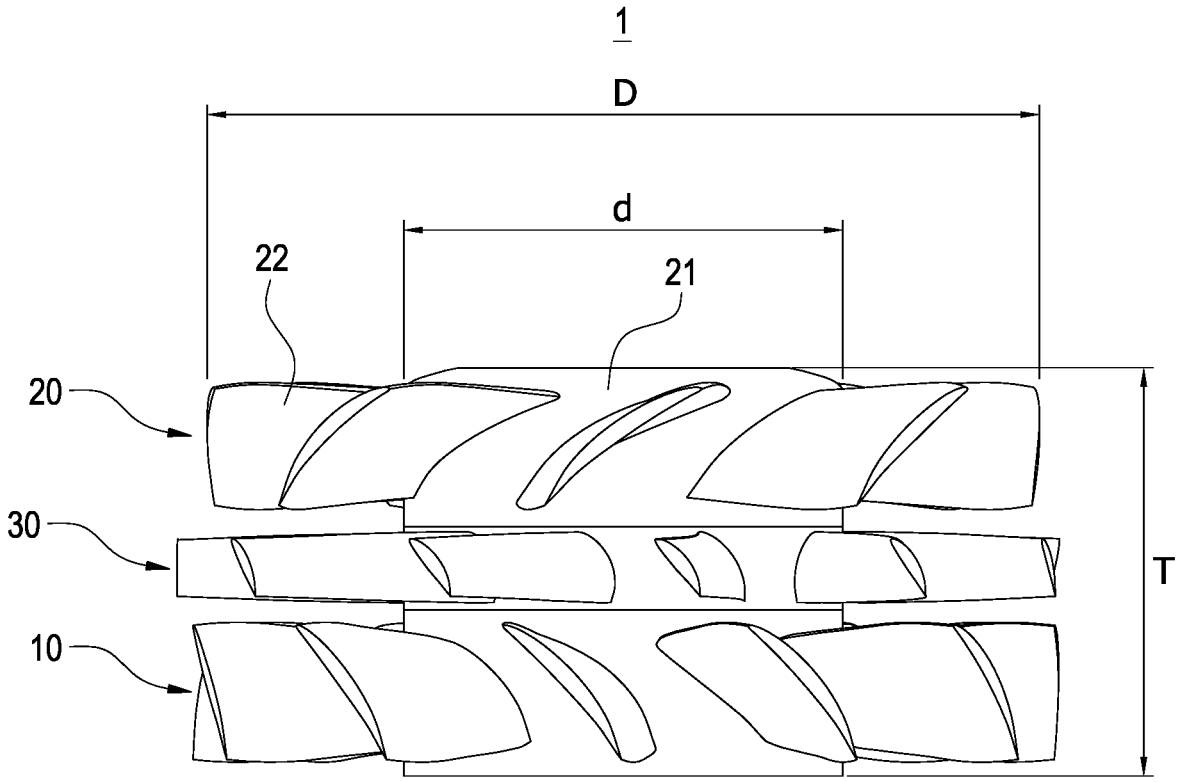
FIG. 3 is a side view of the counter-rotating axial air moving device structure in this disclosure.

Please refer to FIG. 2 and FIG. 3, which depict a perspective schematic view and a side view of the counter-rotating axial air moving device structure in this disclosure respectively. The counter-rotating axial air moving device structure 1 of this disclosure includes a front rotor 10, a rear rotor 20 and a stator component 30. The rear rotor 20 is disposed on a downstream side of the front rotor 10 and receives a forced air flow generated from the front rotor 10. Additionally, the front rotor 10 and the rear rotor 20 include rotating blades respectively, and the rotation directions of the front rotor 10 and the rear rotor 20 are opposite. In other words, the front rotor 10 and the rear rotor 20 rotate in opposite directions.

In this embodiment, the stator component 30 includes a plurality of stator blades. The stator blades are arranged to recover the rotational kinetic energy of the air flow passing the front rotor 10. It should be noted that in some embodiments, the counter-rotating axial air moving device structure 1 of this disclosure may not have the stator component 30.

Furthermore, the stator component 30 is optionally located on a front or rear side of the front rotor 10, on a rear side of the rear rotor 20 or between the front rotor 10 and the rear rotor 20. In some embodiments, the stator component 30 may include a plurality of pillars or a plurality of stator blades with wing sections, and the pillars or the stator blades are arranged radially corresponding to the rotor blade design.

In this embodiment, the front rotor 10, the rear rotor 20 and the stator component 30 are stacked with each other to have a total thickness T and a diameter D. The ratio of the total thickness T to the diameter D is equal to or greater than about 0.25 and equal to or less than 0.8. That is, the counter-rotating axial air moving device structure 1 is considered a relatively thin type of counter-rotating axial air moving device.

Specifically, the hub diameter d and the rotor diameter D of the front rotor 10 are the same with the hub diameter d and the rotor diameter D of the rear rotor 20 respectively (equivalent to the diameter D). The ratio of the hub diameter d to the rotor diameter D is between about 0.15 and about 0.75. Moreover, the ratio of the rotation speed of the rear rotor 20 to the rotation speed of the front rotor is equal to or greater than about 0.5 and equal to or less than about 1.2.

The main feature of the counter-rotating axial air moving device structure 1 of this disclosure is the design of the pitch angles of the blades of the rear rotor 20. The detailed description is as follows.

Figure 4:
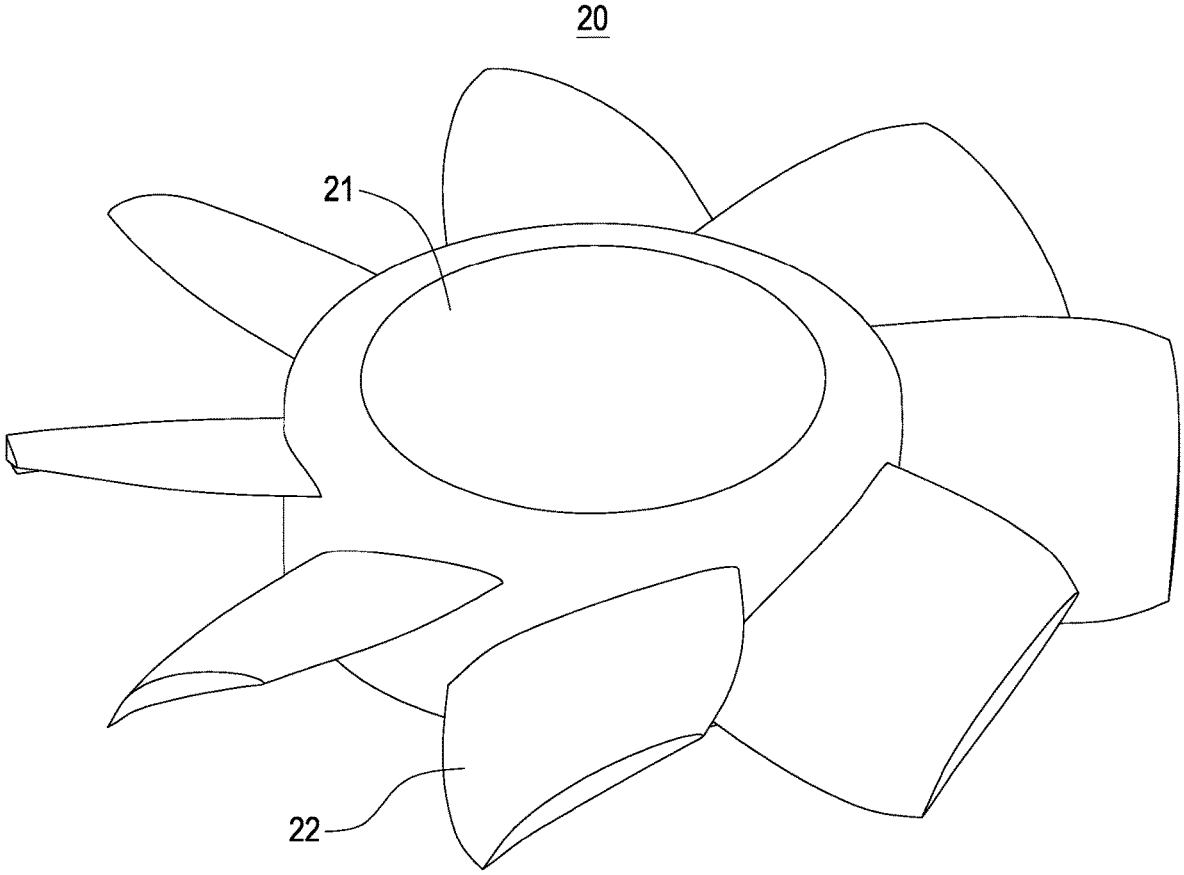
FIG. 4 is a perspective schematic view of the rear rotor in this disclosure.
Figure 5:
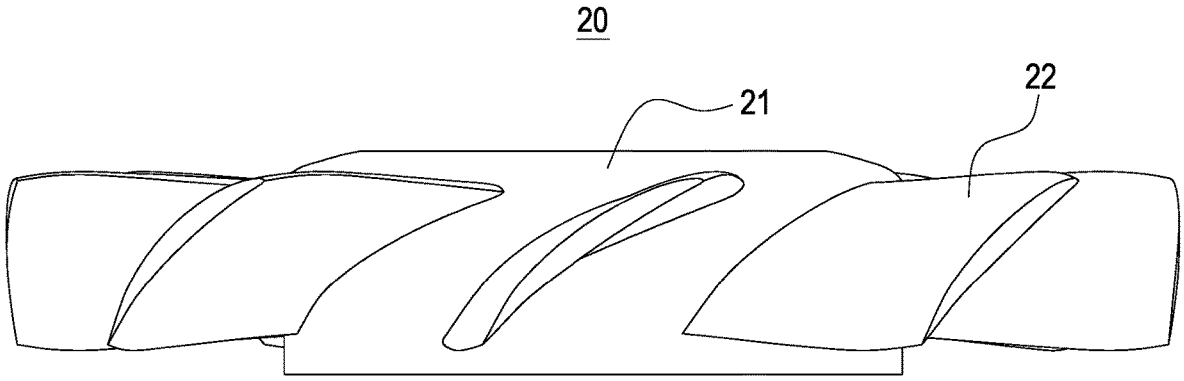
FIG. 5 is a side view of the rear rotor in this disclosure.
Figure 6:
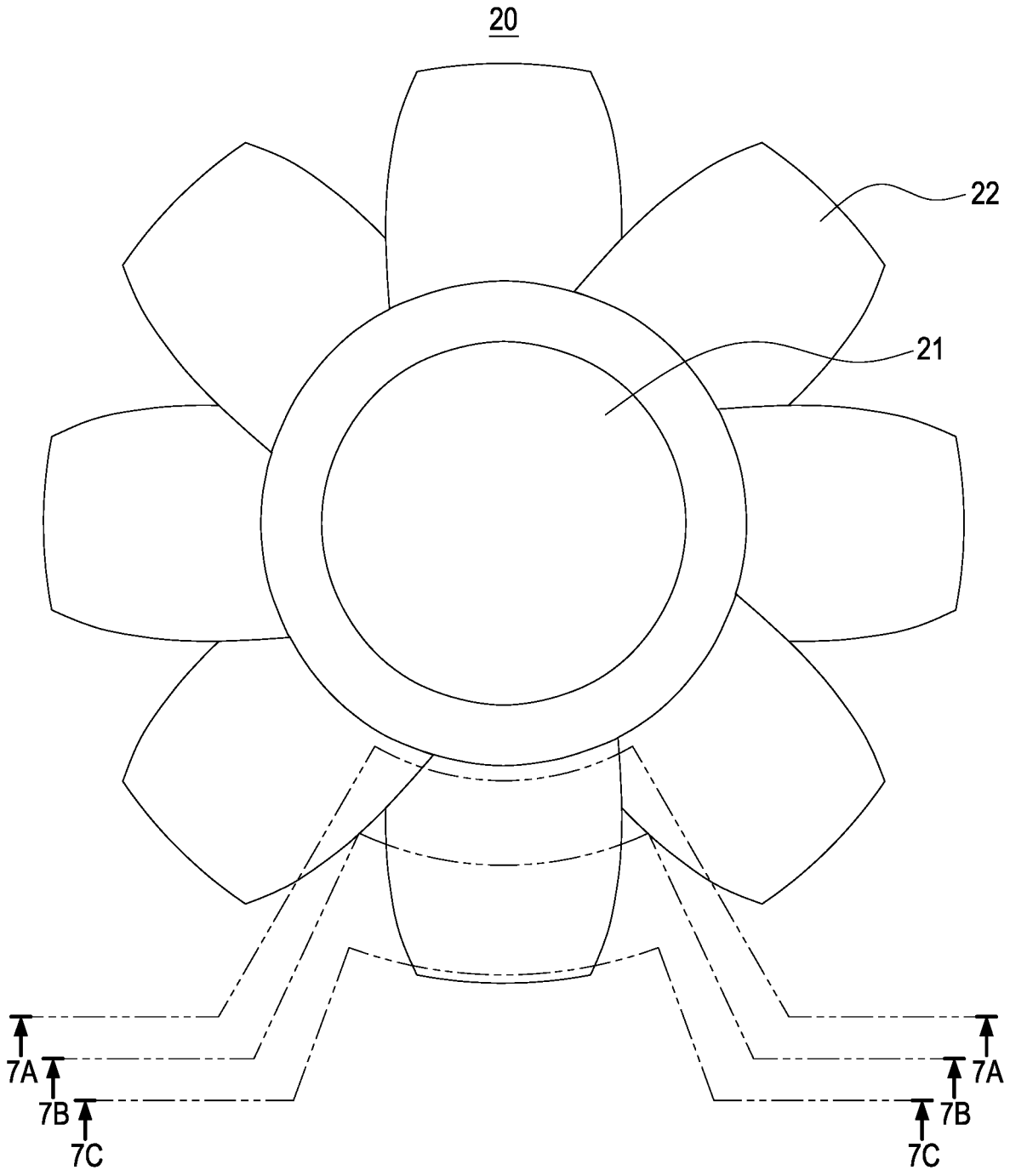
FIG. 6 is a top view of the rear rotor in this disclosure.

Please further refer to FIG. 4 to FIG. 6, which depict a perspective schematic view, a side view and a top view of the rear rotor in this disclosure respectively. As shown in FIG. 4 and FIG. 5, the rear rotor 20 of this disclosure includes a rear hub 21 and a plurality of rear blades 22 arranged on the periphery of the rear hub 21. The rear blades 22 are arranged annularly on the periphery of the rear hub 21 spacedly and are located at the same height.

Please refer to FIG. 6, the rear blades 22 of the rear rotor 20 in this disclosure is extended from the periphery of the rear hub 21 (inner side of the blade) in a direction away from the rear hub 21 (outer side of the blade). Each rear blade 22 is configured by stacking multiple two-dimensional wing sections. Under the cylindrical coordinates, the wing sections are predetermined on different radius positions of each rear blade 22 are lofted continuously to complete the configuration of the three-dimensional blade. In this embodiment, the two-dimensional wing sections are shown in FIG. 7A to FIG. 7C, which are respectively cross-sectional views of the rear blades 22 on the inner location of the blade (line 7A-7A in FIG. 6), on the middle location of the blade (line 7B-7B in FIG. 6) and on the outer location of the blade (line 7C-7C in FIG. 6).

Figure 7A:
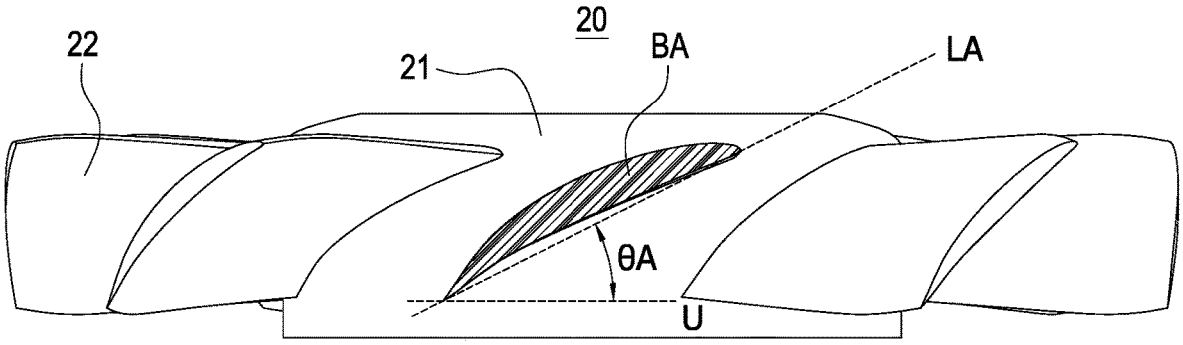
FIG. 7A is a cross sectional view of line 7A-7A in FIG. 6.
Figure 7B:
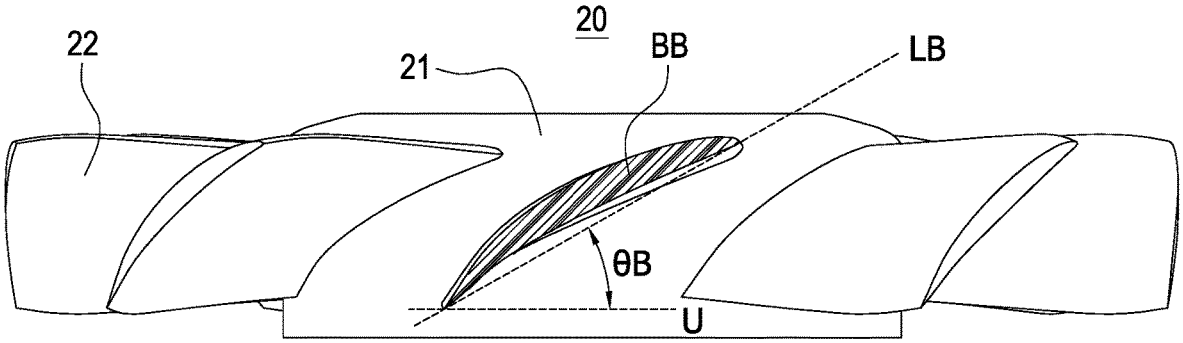
FIG. 7B is a cross sectional view of line 7B-7B in FIG. 6.
Figure 7C:
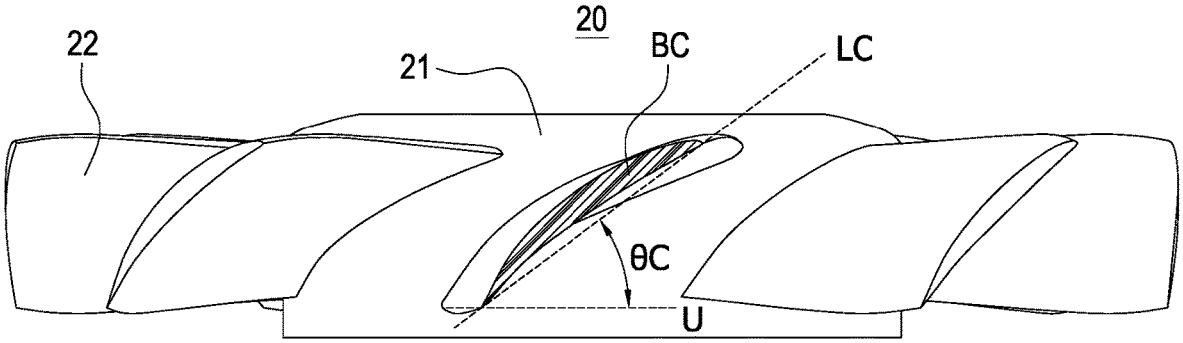
FIG. 7C is a cross sectional view of line 7C-7C line in FIG. 6.

Please further refer to FIG. 7A to FIG. 7C, which depict cross sectional views of the rear rotor blade on different radius positions of this disclosure. The rear rotor 20 of this disclosure includes a rear hub 21 and a plurality of rear blades 22. In FIG. 7A, a wing section BA is shown by making a cross sectional view of the rear blade 22 on the inner location of the blade (line 7A-7A in FIG. 6). The pitch angle $\theta_A$ is the angle formed between the nose-tail line LA of the wing section BA and the rotation direction U of the rear rotor 20.

In FIG. 7B, similarly, a wing section BB is shown by making a cross sectional view of the rear blade 22 on the middle location of the blade (line 7B-7B in FIG. 6). The pitch angle $\theta_B$ is the angle formed between the nose-tail line LB of the wing section BB and the rotation direction U of the rear rotor 20. In FIG. 7C, a wing section BC is shown by making a cross sectional view of the rear blade 22 on the outer location of the blade (line 7C-7C in FIG. 6). The pitch angle $\theta_C$ is the angle formed between the nose-tail line LC of the wing section BC and the rotation direction U of the rear rotor 20.

Figure 8:
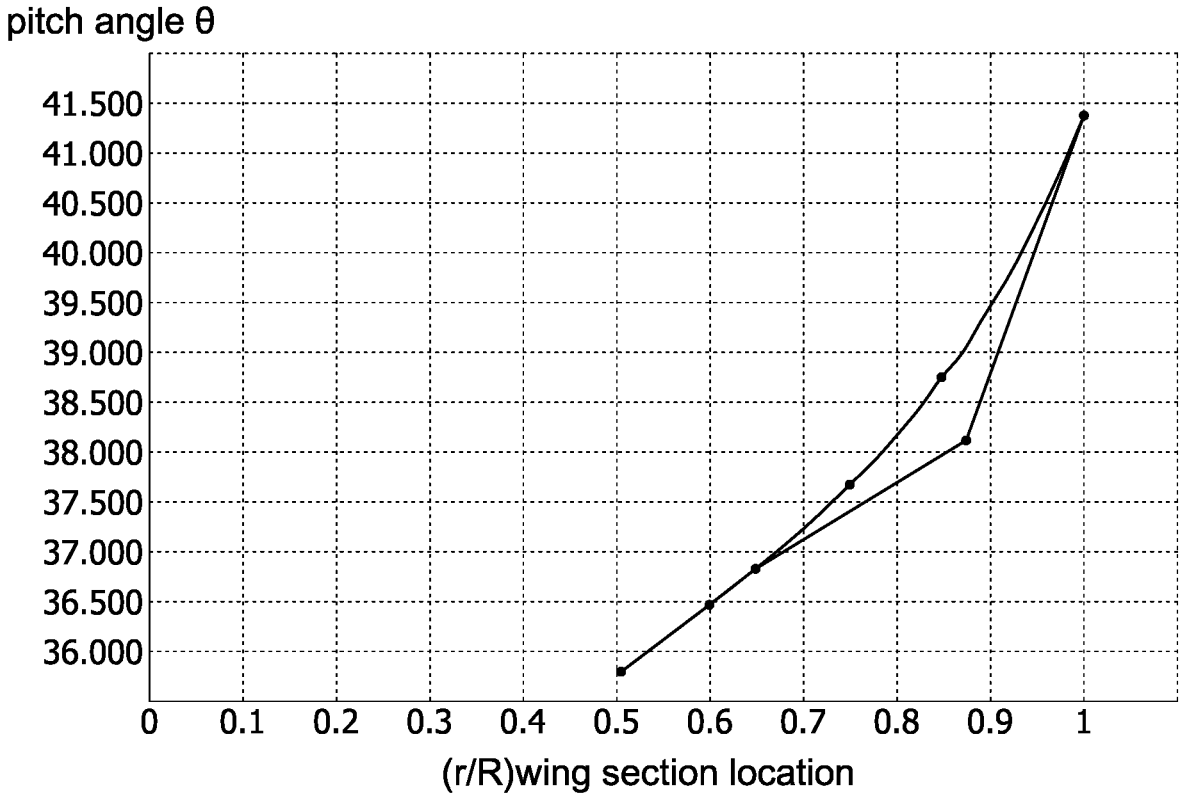
FIG. 8 is a schematic diagram of the pitch angles of the rear rotor on different radius positions in this disclosure.

Please further refer to FIG. 8, which depict a schematic diagram of the pitch angles of the rear rotor blade on different radius positions of this disclosure. After comparing FIG. 7A to FIG. 7C, the pitch angle θ of the rear blades 22 in this disclosure increases gradually from the inner side of the blade to the outer side of the blade. That is, the pitch angle θ of the rear blades 22 of this disclosure increases gradually from the rear hub 10 in a direction away from the rear hub 10. In some embodiments, the pitch angle θ of the rear blade 22 is arranged to increase from the inner side of the blade to the outer side of the blade. In some embodiments, a slight deviation may not affect the effect and is still in the scope of this disclosure.

Figure 9:
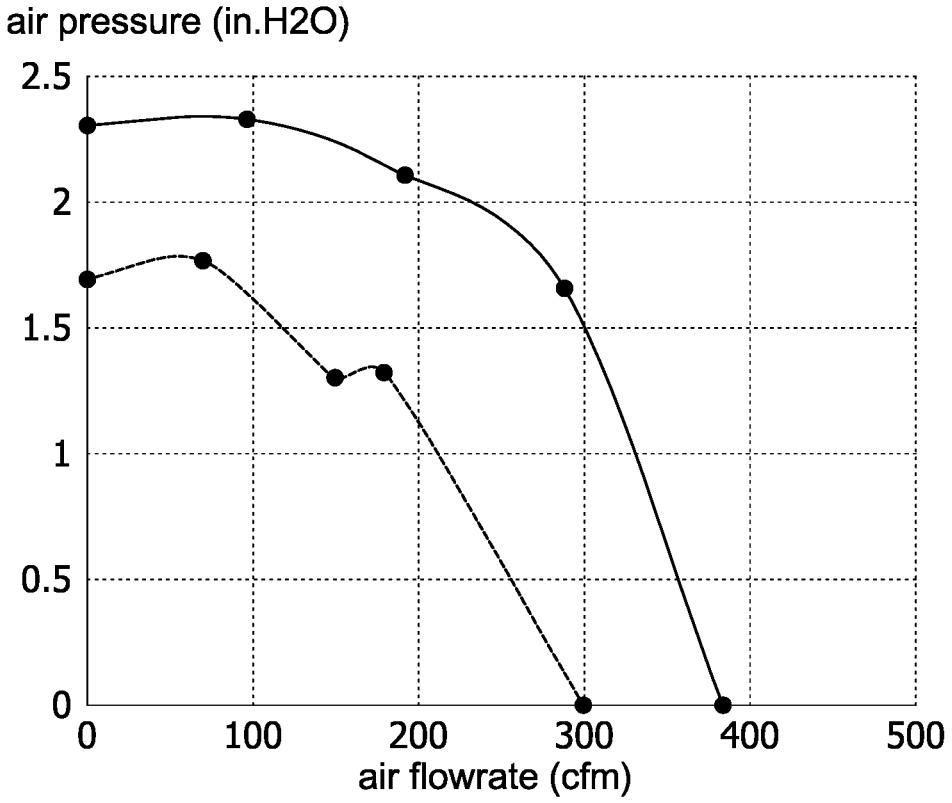
FIG. 9 is a comparison diagram of curves of the static pressure versus air flowrate of the counter-rotating axial air moving device structure in this disclosure and the counter-rotating axial air moving device in the related art.

Please further refer to FIG. 9, which depicts a comparison diagram of performance curves of the static pressure versus air flowrate of the counter rotating axial air moving device structure of this disclosure and the counter rotating axial air moving device of the related art under the same size and the same rotation speed. It is shown from the figure that, under the same air flowrate, the counter-rotating axial air moving device structure of this disclosure (presented in the solid line) has a higher air pressure than the counter-rotating axial air moving device structure of the related art (presented in the dotted line). In other words, under the same air pressure, the counter-rotating axial air moving device structure of this disclosure has a relatively higher air flowrate. Accordingly, the counter-rotating axial air moving device structure of this disclosure has higher air pressure and higher air flowrate comparing with the counter-rotating axial air moving device of the related art at the same rotation speed. Therefore, the deterioration of vibration and noise caused by increasing of the rotation speed may be avoided and the energy consumption is reduced.

While this disclosure has been described by means of specific embodiments, numerous modifications and variations could be made thereto by those skilled in the art without departing from the scope and spirit of this disclosure set forth in the claims.

What is claimed is:

1. A counter-rotating axial air moving device structure, comprising:

a front rotor; and a rear rotor, disposed on a downstream side of the front rotor and receiving a forced air flow generated from the front rotor, the rear rotor comprising a rear hub and a plurality of rear blades arranged on a periphery of the rear hub, and a pitch angle of each of the rear blades increasing gradually in a direction radially away from the rear hub;

wherein, the front rotor and the rear rotor are stacked with each other to comprise a total thickness and a diameter, and a ratio of the total thickness to the diameter is equal to or greater than about 0.25 and equal to or less than about 0.8.

2. The counter-rotating axial air moving device structure according to claim 1, wherein the front rotor and the rear rotor rotate in opposite directions.

3. The counter-rotating axial air moving device structure according to claim 1, wherein a hub diameter and a rotor diameter of the front rotor are the same with a hub diameter and a rotor diameter of the rear rotor respectively, and a ratio of the hub diameter to the rotor diameter is between about 0.15 and about 0.75.

4. The counter-rotating axial air moving device structure according to claim 1, wherein a ratio of a rotation speed of the rear rotor to a rotation speed of the front rotor is equal to or greater than about 0.5 and equal to or less than about 1.2.

5. The counter-rotating axial air moving device structure according to claim 1, further comprising a stator component, optionally located on a front or rear side of the front rotor, on a rear side of the rear rotor or between the front rotor and the rear rotor; and the font rotor, the rear rotor and the stator component are stacked with each other to comprise the total thickness and the diameter, and the ratio of the thickness to the diameter is equal to or greater than about 0.25 and equal to or less than about 0.8.

6. The counter-rotating axial air moving device structure according to claim 5, wherein the stator component comprises a plurality of pillars or a plurality of stator blades, and the pillars or the stator blades are arranged radially.

* * * * *